US006627064B1

(12) United States Patent
Hans

(10) Patent No.: US 6,627,064 B1
(45) Date of Patent: Sep. 30, 2003

(54) METHOD FOR REMOVING THE HARD MATERIAL COATING APPLIED ON A HARD METAL WORKPIECE AND A HOLDING DEVICE FOR AT LEAST ONE WORKPIECE

(75) Inventor: Michael Hans, Bludenz (AT)

(73) Assignee: Unaxis Balzers Aktiengesellschaft, Furstentum (LI)

( * ) Notice: Subject to any disclaimer, the term of this patent is extended or adjusted under 35 U.S.C. 154(b) by 17 days.

(21) Appl. No.: 09/693,906

(22) Filed: Oct. 23, 2000

(51) Int. Cl.[7] ..... C25F 5/00; C25F 3/00; C25D 17/04

(52) U.S. Cl. ..... 205/646; 205/662; 205/664; 205/668; 205/684; 205/685; 204/297.01; 204/297.05

(58) Field of Search ..... 205/704, 705, 205/723, 662, 664, 668, 646, 684, 685; 204/297.01, 297.05

(56) References Cited

U.S. PATENT DOCUMENTS

| | | | | | |
|---|---|---|---|---|---|
| 3,725,224 | A | * | 4/1973 | Kendall | 205/722 |
| 4,128,463 | A | * | 12/1978 | Formanik | 205/717 |
| 4,886,588 | A | * | 12/1989 | Curfman | 205/717 |
| 4,975,163 | A | * | 12/1990 | Danielson | 205/717 |
| 5,062,941 | A | * | 11/1991 | Sue | 205/717 |
| 5,227,041 | A | * | 7/1993 | Brogden et al. | 204/297.05 |
| 6,176,999 | B1 | * | 1/2001 | Jaworowski et al. | 205/717 |

* cited by examiner

*Primary Examiner*—Donald R. Valentine
(74) *Attorney, Agent, or Firm*—Crowell & Moring LLP

(57) ABSTRACT

A hard material layer deposited on a hard metal work piece is removed by electrolytic passivation in which a maximum current density equal to at least 0.01 A/cm$^2$ is generated on the work piece at the beginning of the layer removal process. The hard material layer rapidly flakes off without causing substantial damage to the hard metal material located underneath.

40 Claims, 1 Drawing Sheet

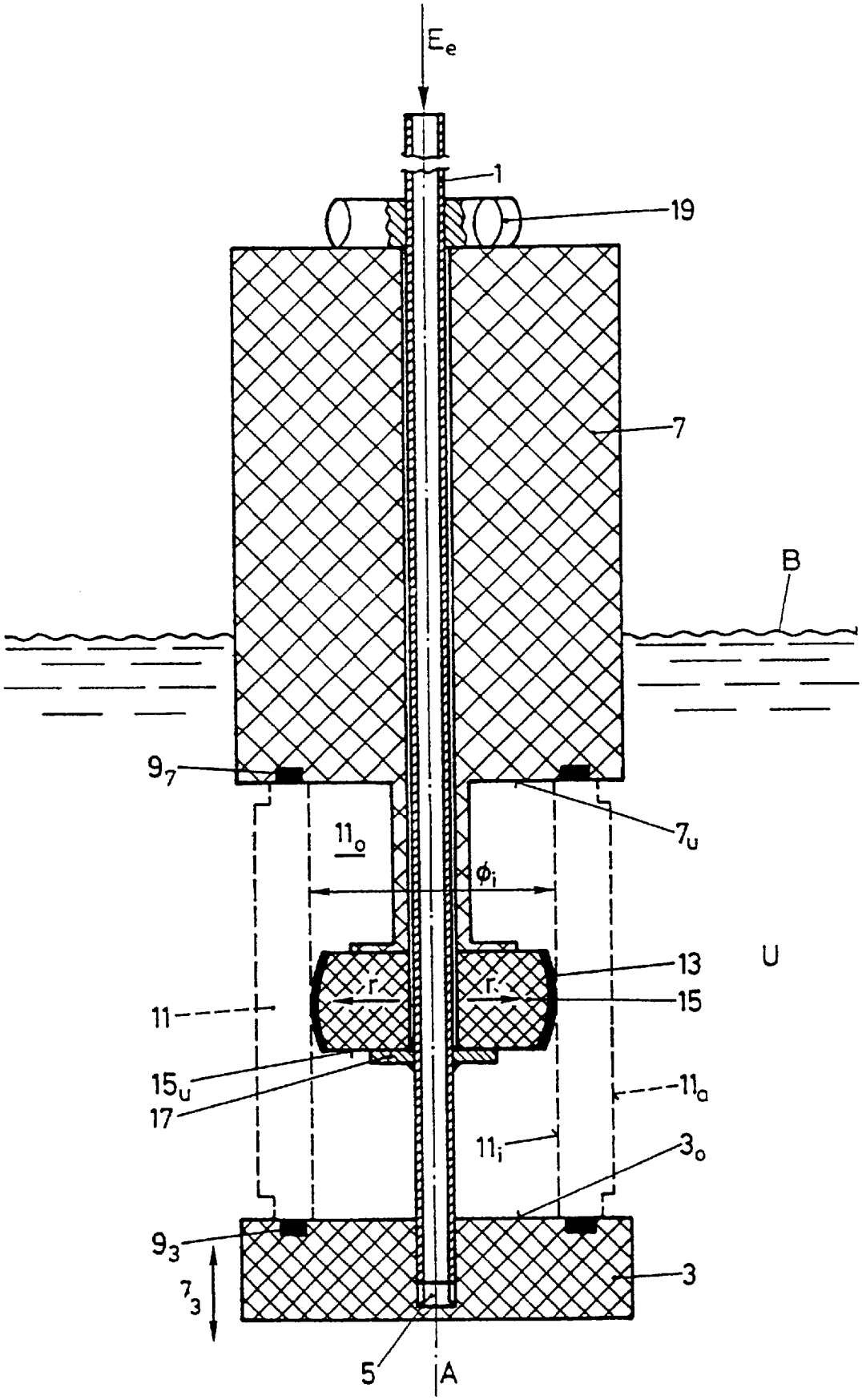
$E_e$
1
19
7
B
$9_7$
$7_u$
$11_o$
$\phi_i$
13
U
r
r
15
11
$15_u$
17
$11_a$
$11_i$
$3_o$
$9_3$
3
$7_3$
5
A

METHOD FOR REMOVING THE HARD MATERIAL COATING APPLIED ON A HARD METAL WORKPIECE AND A HOLDING DEVICE FOR AT LEAST ONE WORKPIECE

BACKGROUND AND SUMMARY OF THE INVENTION

The present invention relates to an electrolytic passivation method for removing a hard metal layer, applied on a hard metal workpiece. Furthermore, it relates to a method for the renewed preparation of a hard metal workpiece with the help of the aforementioned coating-removal method, as well as to a holding device.

To improve the surface properties of hard metal workpieces, such as the service life and/or the effectiveness of tools, especially of throwaway carbide indexable inserts, drills, milling cutters, metal forming tools and stamping tools, it is customary at the present time to coat such workpieces with a layer of hard material, such as titanium nitride or titanium carbonitride. As coating methods, preferably the widespread vacuum-coating methods are used. Since hard metal workpieces, especially those of complex shape, such as those of the above-named tools, are expensive, an attempt is made to rescue the workpiece, if the coating is faulty or to restore the shape and to coat the workpiece once again, when the latter has become worn through use. For this purpose, the coating of the workpieces in question must first be removed. Removing the coating from workpieces of the type mentioned is a difficult and challenging technical problem. Whether this problem is brought to a solution that can be used economically is, in the final analysis, of decisive importance for the question of whether workpieces mentioned can be reworked or disposed of economically. Even if the coating procedure is carried out carefully, process defects or process interruptions, which can lead to a defective coating of the hard metal workpieces with the hard material coating, occur time and again. In commission coating plants, customer requirements with respect to the type and/or thickness of the coating can be mixed up. The cost of rejects resulting therefrom is particularly high in the case of hard metal workpieces. The cost of the uncoated workpiece, the basic body, can easily amount to 3 to 10 times the value of the coating.

For removing coatings from steel workpieces, a method has been known for some time from DE-41 01 843, which permits the stripping of the layer of hard material. This method uses a solution of hydrogen peroxide, which dissolves titanium compounds and other hard material compounds. The intent here is not to attack and damage the workpiece itself in an impermissible manner. The use of acids and alkalis, for example, would damage the steel workpieces in an impermissible manner. This method is completely unsuitable for hard metal, which consists predominantly of the hard material tungsten carbide and the chemically less stable cobalt, because the basic hard metal body of the workpieces would be destroyed at a rate faster than that at which the layer of hard material is dissolved.

For this reason, mechanical methods are used largely at the present time for removing the hard material layer from defectively coated hard metal workpieces or for such workpieces, which are to be coated once again. The layer of hard material is ground or polished off. The costs of this procedure are high. For this reason, such methods are used extremely infrequently and, instead, defective workpieces are disposed of.

From the "Research Disclosure" of April 1996, a method has now become known under the category No. 38447 for removing a layer of hard material, applied on a hard metal workpiece, for which the layer is removed by electrolytic passivation. For this method, a tungsten oxide layer is formed between the hard material layer and the hard metal basic body. This passivation of the tungsten carbide is accomplished by the anodic polarization of the workpiece in a suitable electrolyte. Because of the transformation of the tungsten carbide into tungsten oxide, the hard material layer loses its adhesion to the basic body and flakes off.

The conditions, which must be selected for removing the coating, are extremely critical. If the wrong parameters are selected, either the layer is not removed or the workpiece is damaged irreparably.

The state of the art also involves the re-coating of tools without a prior removal of layers. For this purpose, the tools, preferably shaft tools of a hard metal, such as milling tools, drills and hobbers, are reground at the cutting surfaces and subsequently coated once again. This method has the disadvantage that only the cutting surfaces are freed from the coating by regrinding; however, the remaining regions of the tool remain coated. Therefore, during the subsequent overcoating, the thickness of the layer of hard material steadily increases in the regions that have not been reground. As the thickness of the layer increases, the inherent stresses in the layer of hard material increase and lead to a reduction in the service life of the tool in comparison to a tool which has only been coated once. When a coated tool is reground, the inherent stresses frequently lead to portions breaking off in the region of the transition from the coated to the uncoated part and decrease the operating efficiency of the tool.

It is therefore an object of the present invention to eliminate the disadvantages of the state of the art and to realize a more economic coating-removal process. This is accomplished according to the present invention owing to the fact that, at the start of the coating-removal process, a current density maximum is brought about at the workpiece, which is at least 0.01 $A/cm^2$ and preferably even 0.1 $A/cm^2$. By these means, the above-mentioned problem is solved and service lives are attained which are at least almost equivalent to those attained with new tools.

It has namely turned out that, when these conditions are maintained, the necessary time span during which the workpiece is exposed to the electrolysis until complete removal of the coating is achieved can be reduced drastically and the time of action and the depth of action of the electrolysis on the hard metal can also be reduced drastically. The economic efficiency of the inventive method is simultaneously increased from two points of view, namely, owing to the fact that, on the one hand, the time necessary for the removal of the coating is reduced significantly, which obviously increases the throughput of the decoating process significantly. On the other, a subsequent mechanical treatment is significantly shorter, because the surface erosion necessary for a good adhesion of the layer of hard material that is to be applied once again is reduced significantly.

Surprisingly, it has turned out that, by adhering to the current conditions mentioned, the layer of hard material is blasted off practically all of a sudden and, with that, there is hardly any more time left over for the electrolysis to damage the basic hard metal body than is required for the above-mentioned blasting-off.

As far as is known at the present time, the method proposed pursuant to the invention is suitable for removing all conductive hard material coatings, which are customarily used, such as hard material coatings of nitrates and carbides, carbonitrides of metals or metal compounds, such as TiAlN, TiAlNC, WC, WCN, etc., but also of chromium-containing hard material coatings, such as those of Cr, CrN, CrC, CrNC, as well as combinations of these hard material layers or also multi-layer arrangements.

Contrary to previous teachings, the electrolyte selected does not play a significant role, provided that it is in the acidic range and that its conductivity, together with the voltage applied, permits the above-mentioned current conditions to be maintained. At the same time, the workpiece is rapidly brought to an electrical potential, at which the tungsten of the hard metal is rapidly brought into a passive state.

Furthermore, with respect to the cathode, a voltage is preferably applied to the workpiece, which amounts to at least 1 V and especially preferably at least 6 V and particularly at least 15 V. Preferably, this voltage applied is kept constant over the treatment time and is, for example, controlled and, in any case, dimensioned so that, as a function of the conductivity of the electrolyte chosen, the initially mentioned condition is maintained. Preferably, the voltage is applied directly without a ramp.

Furthermore, it is also possible to work with a voltage which rises, for example, in ramp fashion and is variable over time. In any case, the voltage, named with respect to the cathode, should be reached at the workpiece in less than 5 minutes and preferably in less than even one minute after the start of the voltage increase.

As the electrolyte, preferably an acidic medium is selected, which preferably has a pH ranging from 1 to 7 and especially from 2 to 5. An electrolyte solution which is highly cost effective and advantageous with respect to the environment and safety comprises acetic acid and consists preferably of acetic acid and at least one conductive salt, preferably a nitrate salt.

The inventive method results in coating-removal times, which in any case are shorter than 1 hour and preferably shorter than 15 minutes and particularly shorter than 5 minutes and may amount even to less than 1 minute. It is a significant distinguishing feature of the present invention that the detachment of the layer takes place rapidly. This technical realization of minimizing any harmful effects on the hard metal is clearly in the agreement with the requirement of economic efficiency. In the state of the art, using a peroxide solution for the detachment of layers from steel workpieces, times of more than 1 hour are required and, if even better results are to be attained, times of more than 10 hours frequently are used. On the other hand, in the case of the proposed, inventive procedure, extremely short times already lead to a success, which also minimizes a subsequent removing and, with that, dimension changing treatment.

Aside from the conductivity of the electrolytes mentioned, which is reached readily with the proposed composition, a suitable supplying device must also specifically be selected, so that this device can also supply an adequate overall current density. As already mentioned, the supplying device preferably is operated at a stabilized voltage, which ensures that the minimum initial current specified is reached rapidly.

Due to the targeted action on the workpiece with the electrolyte, the coating can be removed over the whole surface or also only partially, depending on the use to which the workpiece is put.

In spite of the inventive procedure, mechanical finishing, preferably by polishing and/or grinding and/or by micro-sandblasting, especially by the latter, is required for removing tungsten oxide. However, as already mentioned, this finishing work is reduced significantly pursuant to the invention. Furthermore, edge zones of the surface, from which the coating is removed, may moreover be depleted of cobalt and therefore have to be removed. The well-known methods for checking the ability to coat hard metals, such as those described, for example, in the German Offenlegungsschrift 43 26 852, are suitable for testing whether such finishing is necessary.

Furthermore, the operating temperature of the electrolyte bath is not critical for the inventive method. It is readily possible to carry out the coating-removal process for economic reasons preferably at ambient temperatures, that is, in the normal case at about 20° C.

Whether a workpiece of hard metal has already once before had a coating removed pursuant to the inventive method and was then mechanically finished minimally and coated once again, can be determined only to a limited extent on the workpiece itself. In the case of tools, such as those named above, it is possible in certain cases to recognize wear marks, which have not been removed by the mechanical finishing, necessary only minimally pursuant to the invention, on surfaces, such as minor cutting surfaces. In spite of the new hard material layer applied, such wear marks generally are still recognizable. A basic distinguishing difference for all mechanically finished hard metal tools, such as ground, polished or micro-sandblasted hard metal tools, may be reflected in the change in appearance of the tool. However, especially this distinguishing difference is minimized by the inventive procedure. As a result, the size accuracy of the workpiece is increased in spite of the finishing. When the passivation layer that has been left behind which, pursuant to the invention, is only as a thick as required for a rapid peeling of the layer of hard material, is removed, a dull appearance of the surface of the basic body results, for example, due to the use of micro-sandblasting.

Tools from which a coating must be removed and another subsequently applied generally have already been used and may have, for example, the following distinguishing wear features.

Shaft tools may have pressure or chafing marks, which originate from the clamping chuck. Furthermore, cutting edge breaks or, at least, newly coated jaggednesses can frequently be recognized. Compared to the length of a new tool or the conventional standard length, a reduction in the tool length can usually be recognized. This is the case particularly when the tools have been overhauled and refinished repeatedly. This can also show itself in a length scatter within the same group of tools. In addition, there may also be diameter differences. In the case of shaft tools, which were refinished mechanically at the periphery, there generally is a change from the nominal diameter imprinted in the shaft.

In the case of used hobbers, whole teeth are frequently broken off. In the state as delivered, this can be recognized by a simple optical inspection. After the face has been reground repeatedly, a clear reduction in the width of the tip of the tooth or of the major flank can usually be recognized. A re-profiling of the hobber frequently results in a measurable change in the diameter of the tool. Usually, changes worth mentioning in the dimensions can be recognized clearly already after the third or fourth re-grinding of the face.

Furthermore, the inventive method is carried out on workpieces with at least a first surface region on which a layer of hard material is applied or, at the very least, was applied, and a second surface region, on which no layer of hard material was applied, preferably so that the workpiece comes into contact exclusively with the electrolyte at the first-mentioned surface region. For example, if shaft tools are brought into contact with the electrolyte at the uncoated shafts, then the passivation during the electrolysis, utilized pursuant to the invention, can be adversely affected. For the immersion, such tools are held at the shaft with tongs or a different clamping device and immersed only as far as they are coated. At the same time, the holding device, which is provided, is connected electrically with the anode. With the exception of cases, in which at least parts of the holding device which are intended to come into contact with the electrolyte are manufactured from special materials, as explained below, no parts of this holding device may be immersed in the electrolyte. Such parts, such as steel or copper parts, would not be passivated. This would prevent the decoating of the tool, because, in this case, the current would flow largely over the conducting surfaces, which have not been passivated.

For decoating certain tools, such as throwaway carbide indexable inserts or hobbers, that is, tools without a shaft which, because of their small size and/or their largely complete coating with hard material, must be immersed completely in the electrolyte, it is not possible to provide a holding device, which does not also come into contact with the electrolyte. If such holding parts must or should come into contact with the electrolyte, then materials ought to be used for these, which are also passivated and/or which are not electrically conductive during the coating-removal process. Preferably, tungsten and/or tantalum and/or plastics, such as preferably Teflon, are used for this purpose. For example, for removing the coating from throwaway carbide indexable inserts, the latter are clamped to holding parts made from the materials named or are placed on a grid of the above materials. For the electrolysis, the tools are immersed in the electrolyte together with the parts of the holder mentioned.

For certain tools, such as hobbers, which constitute an important area of use for the present invention, it is not possible to immerse surface regions, which are provided with a coating of hard material that is to be removed, in the electrolyte without at the same time also immersing surface regions without a coating of hard materials. In the case of hobbers, which are constructed essentially as hollow cylinders, the inner surface does not have a hard material layer, while the outer surface, the working surface, is coated with such a layer. In the last mentioned case, in order to be able to fulfill the requirement that regions of the workpiece, not coated with hard material, be not brought into contact with the electrolyte, an inventive holding device for at least one workpiece is proposed, at which a metal encapsulation for the surface region of the workpiece, which does not have a layer of hard material, is provided. Although such a holding device was developed out of need in conjunction with the present inventive method, it can readily be seen that it can be used wherever a workpiece with at least one first surface region is to be treated by the action of a gas or liquid and at least one further surface region of the workpiece, on the other hand, is not, the treatment separation being realized by the inventive encapsulation.

If an electric potential is to be applied to a workpiece that is being treated using the holding device mentioned, then this is done preferably over at least one electrical contact for the further surface region of the workpiece in the encapsulation mentioned.

In a preferred embodiment of the inventive holding device for a workpiece with an indentation, whether this be a blind indentation or a through opening, such as a borehole, the workpiece having to be treated selectively at the indentation surface or at the outer surface of the workpiece, sealing elements, which separate the inner surface from the outer surface of the workpiece, are provided at the holding device. For the treatment or holding of a workpiece, especially of a hobber, with through openings, of which only the outer surface is to be treated, the holding device has a pair of sealing elements, which are in contact with the face of the workpiece around the opening and are disposed axially offset along a supporting rod, the section of which, lying between the sealing elements, is dimensioned, so that it can be passed through the opening.

The sealing organs can be shifted axially relative to one another in order to be braced against the faces of the workpiece.

Furthermore, an electrical contacting arrangement is preferably provided at the section of the rod, provided between the sealing organs. Furthermore, the electrical lead to the contact arrangement preferably is passed through the rod.

In one embodiment of the last-mentioned holding device, a clamping body, which can be expanded or contracted radially with respect to the axis of the rod by axial clamping and at the periphery of which the contact elements are provided, is provided at the rod section located between the sealing organs. Moreover, clamping organs for the clamping body, acting in the direction of the lance axis, are provided at the holding device in order to clamp the contact elements against the workpiece by clamping the clamping body. By these means, it is possible to contact the workpiece electrically in an optimum manner in further regions, independently of the diameter of the opening.

However, a simplified embodiment, for which a radially elastic contact body is introduced into the opening and, without additionally clamping, ensures the electrical contact, is preferred.

If an inventive holding device is used for the inventive method, it is unavoidable that parts of the holding device come into contact with the electrolyte. For this reason, it is furthermore proposed for the holding device of the last-mentioned embodiment that the section of the holding device on either side of the sealing organs towards the outside, have an outer surface of a plastic, preferably of polytetrafluoroethylene, marketed under the trademark "Teflon".

As already mentioned, the inventive holding device is particularly suitable for holding the workpiece while carrying out the inventive method mentioned above.

This method is suitable particularly for removing a coating from shaft tools, such as drills or shank type cutters and furthermore for removing the coating from throwaway carbide indexable inserts, metal forming tools and embossing dies, etc., especially from hobbers. The inventive holding device is suitable especially for tools with a through hole. In connection with the inventive method, it is suitable particularly for the aforementioned hobber.

To begin with, the procedure for removing the coating from workpieces by means of the inventive method is described further with the help of examples.

A total of 60 throwaway carbide indexable inserts of hard metal, which were coated with a 4 mm layer of TiN, were treated anodically in an electrolyte. The electrolyte consisted of 2M acetic acid and 2M ammonium nitrate, and had a pH of about 2.5 and an operating temperature of about 20° C.

After the power supply was switched on, the electrolysis current increased rapidly to about 50 A, while the voltage was kept constant at 10 V. After reaching a maximum at the aforementioned 50 A, the current decreased and, after a period of about 10 minutes, reached a value of 2 A. After a coating-removal time of 10 minutes, the coating was removed completely from all throwaway carbide indexable inserts. The maximum electrolysis current of 50 A was reached immediately after the power supply was switched on and provided a clear current maximum, corresponding to a current density maximum at the surface of the workpiece at the start of the decoating process. The size of the throwaway carbide indexable inserts was 30×30×5 mm, which corresponds to a surface area of 24 cm per plate or to a total surface area of 1440 $cm^2$. The maximum electrolysis current of 50 A therefore resulted in a maximum current density at the workpieces of 0.035 $A/cm^2$ at the beginning of the decoating process. A more accurate clarification of when the decoating process was already finished revealed that this was the case already after a few minutes. When the initial current density was increased to 0.1 $A/cm^2$, the throwaway carbide indexable inserts were decoated already in about 10 seconds. It follows from this that, when the applied maximum current density is greater than 0.01 $A/cm^2$, the decoating process is significantly shorter than 1 hour and already is shorter than 15 minutes and that, when the maximum current density is preferably increased to at least 0.1 $A/cm^2$ of decoating surface, the decoating is concluded in less than 1 minute.

Moreover, under the aforementioned electrolysis conditions, hard metal drills and hard metal milling cutters were decoated. The tools had been coated with hard material coatings of titanium carbonitride or titanium aluminum nitride deposited by means of PVD. The thickness of the layer was 3 mm. By maintaining a maximum initial current density of at least 0.01 $A/cm^2$ of decoating surface, the drills or milling tools were decoated within a minute. Subsequently, the tools were micro-sandblasted briefly to remove slight cobalt-depleted zones and, after that, coated once more with a 3 mm layer of hard material.

Furthermore, hobbers were decoated with the help of the inventive holding device in the above-mentioned electrolyte solution of pH 2. By using the above-mentioned holder, the details of which are still to be described, it was ensured that only the working surfaces of the milling cutters, coated with hard material, came into contact with the electrolyte. With an active surface area of approximately 1000 $cm^2$ and an initial maximum current density of 0.02 $A/cm^2$, decoating of the hobber resulted already within 3 minutes. By applying a constant voltage, an initial maximum current, corresponding to the maximum current density required, of 25 A per hobber treated simultaneously resulted and, within the aforementioned period of 3 minutes, dropped to below 4 A per hobber.

Moreover, a hobber was decoated within 3 minutes in the ammonium nitrate and acetic acid electrolyte by applying a voltage of 15 V, an initial current of about 300 A and a passive current of about 50 A.

Shaft tools, namely drills or milling cutters, were decoated in an ammonium nitrate and acetic acid electrolyte in 1 minute at a voltage of 15 V, an initial current of about 10 A and a passive current of about 1 A.

A throwaway carbide indexable insert was decoated in an ammonium nitrate and acetic acid electrolyte in 10 seconds at a voltage of 15 V, an initial current of about 3 A and a passive current of about 0.1 A.

Furthermore, metal forming dies and metal forming stamps of hard metal or the hard metal part of steel-reinforced metal forming dies were decoated successfully in a very short time. In the case of the steel-reinforced dies, the steel reinforcement was protected by a Teflon covering before the attack of the electrolyte during the decoating process. After the decoating process, the decoated parts were polished briefly and subsequently coated once again.

Aside from the acetic acid and ammonium nitrate electrolyte, used in the example, other electrolyte compositions, which lead to passivation of the hard metal, can also be used. For example, a sodium nitrate and acetic acid electrolyte, a cerium ammonium nitrate and acetic acid electrolyte, a cerium ammonium nitrate and nitric acid electrolyte or a cerium ammonium nitrate and perchloric acid electrolyte can be used.

The inventive holding device for workpieces is described below by means of a FIGURE.

In the single FIGURE, an embodiment of the inventive holding device is shown diagrammatically and simplified, in longitudinal section.

BRIEF DESCRIPTION OF THE DRAWING

A clamping body 3 with a blind, threaded borehole 5, is screwed into the end of a metal pipe 1. A counter-clamping block 7 is provided, which can be fixed along the pipe 1. At the mutual facing end sides $\mathbf{7}_u$ and $\mathbf{3}_o$ of the two parts 3 and 7, sealing elements $\mathbf{9}_7$ and $\mathbf{9}_3$ are provided. A workpiece 11, in the form of a hobber, which is to be held, is shown in the Figure by broken lines. As is evident, the workpiece 11 is clamped between the end faces $\mathbf{7}_u$ and $\mathbf{3}_o$ of the parts 7 and 3. The sealing elements, such as O-rings $\mathbf{9}_7$ and $\mathbf{9}_3$, form a seal at the end sides of the workpiece 11 in the region of the through hole $\mathbf{11}_o$. By these means, the uncoated inner surface of the workpiece $\mathbf{11}_i$ is encapsulated and separated from the coated outer surface $\mathbf{11}_a$ which can now be exposed to processing by means of an electrolyte B, without affecting the encapsulated inner surface $\mathbf{11}_i$.

It can be seen immediately that the holding device, as described, is outstandingly suitable for the inventive decoating of workpieces 11, of which only the outer surface 11 is to be decoated by contact with the electrolytes mentioned above, while the inner surface 11 is to remain unaffected by the electrolyte.

The inner surface $\mathbf{11}_i$ of the workpiece 11 is contacted electrically over an electrical contacting arrangement 13, the electrical connection for a power supply $E_e$ being made over the metallic pipe outside of the electrolyte.

In order to take into consideration any deviations in or scattering of the internal diameter $\phi_i$ of the cylindrical inner wall $\mathbf{11}_i$ of the workpiece 11, the electrical contacting arrangement 13, as shown in the embodiment of the Figure, can be mounted at the periphery of an elastic, for example, rubber-elastic, actively-tensioned clamping body 15, which lies on a shoulder 17 at the pipe 1. The clamping body 15 is connected firmly with the body 7, both being able to ride axially on the pipe 1. By means of an adjusting organ 19, such as an adjusting nut on a threaded end part of the pipe 1, the clamping body 15 can actively be compressed more or less axially, as indicated by the arrows r. As a result, the clamping body 15 gives way more or less radially towards the outside and, with that, the contact arrangement 13 is displaced correspondingly. The electrical signal, as mentioned, passes over the pipe 1, the collar 17, the underside $\mathbf{15}_u$ of the clamping body 15 to the periphery of the latter. Upon inserting the elastic contact 13, 15, an electrical connection between the tool and the power supply is established.

The workpiece 11 is mounted here as follows:

The clamping body 3 is removed from the pipe 1. Thereupon, the workpiece is inverted over the clamping body 15 and contacts the seals 9. After that, by tightening the adjusting screw 19 and expanding the clamping body 15 within the limits of its inherent elasticity, an optimum electrical contact is established with the inner surface $\mathbf{11}_i$ of the workpiece 11.

After that, the body 3 is put in place. As the latter is screwed on, the workpiece 11 is clamped between the seals $\mathbf{9}_7$ and $\mathbf{9}_3$. As a result, the inner surface $\mathbf{11}_i$ of the workpiece is encapsulated to separate it from the surroundings U and especially from the electrolyte B. Furthermore, an optimum electrical contact, which is largely independent of any clearances, is produced.

In the case of a preferred, significantly simpler embodiment, the elastic clamping body 15 rides fixed on the pipe 1 and the electrical contacting with the inner surface 11*i* of the workpiece 11 is accomplished by elastic contact when the clamping body 15 is pushed into the opening of the workpiece.

In the case of this preferred embodiment, the workpiece 11 is pushed over the pipe 1, to which the elastic clamping body 15 is fixed. The body 7 is then placed from above over the pipe 1 and the workpiece 11 is sealed between the sealing elements $\mathbf{9}_7$ and $\mathbf{9}_3$ by being clamped with the adjusting organ 19, such as an adjusting nut, which is screwed onto the external thread of the pipe 1.

Those parts, which come into contact with the electrolyte U for the outer surface $\mathbf{11}_a$ of the workpiece 11, that is, in particular, with the electrolyte bath B in the preferred use in connection with the inventive electrolytic decoating process, are produced from materials, which do not affect the intended treatment nor are themselves affected by the intended treatment. The clamping body 3 and at least the parts of the counter-clamping body 7 facing the clamping body 3 and preferably the whole surface of the counter-clamping body 7 are made from a plastic material, preferably from Teflon. For the preferred, simplified embodiment of the holding device, the radial adjustability of the contact arrangements 15 is omitted, as was explained.

What is claimed is:

1. A method for manufacturing a hard metal workpiece from a starting hard metal workpiece having a coating of hard material applied thereon, comprising:

applying at least an area of said starting hard metal workpiece from which said coating is to be removed into an electrolyte;

applying a voltage between said starting hard metal workpiece and a cathode in said electrolyte;

controlling said voltage within 5 minutes from applying said voltage so as to result in a current density maximum that is at least 0.01 A/cm$^2$ with respect to said area and thereby removing said hard material coating by electrolytic passivation.

2. A method according to claim 1, wherein the current density maximum is at least 0.1 A/cm$^2$.

3. A method according to claim 1, wherein the starting hard metal workpiece comprises tungsten and is brought to an electrical potential in the electrolyte wherein the tungsten is essentially in a passive state.

4. A method according to claim 1, wherein a voltage at the starting hard metal workpiece with respect to the cathode is at least 1 V, wherein the voltage reaches this value in less than five minutes from the time that the voltage is supplied.

5. A method according to claim 4, wherein the voltage is at least 6 V.

6. A method according to claim 4, wherein the voltage is at least 10 V.

7. A method according to claim 4, wherein the voltage is kept constant over a treatment time.

8. A method according to claim 4, wherein the voltage reaches this value in less than one minute from the time that the voltage is supplied.

9. A method according to claim 1, wherein the electrolyte is an acidic medium having a pH ranging from 1 to 7.

10. A method according to claim 9, wherein the pH ranges from 2 to 5.

11. A method according to claim 1, wherein the electrolyte comprises acetic acid.

12. A method according to claim 1, wherein the electrolyte comprises a solution of at least one conductive salt and acetic acid.

13. A method according to claim 12, wherein the at least one conductive salt is a nitrate salt.

14. A method according to claim 1, wherein the removing is less than one hour.

15. A method according to claim 14, wherein the removing is less than 15 minutes.

16. A method according to claim 14, wherein the removing is less than five minutes.

17. A method according to claim 14, wherein the removing is less than 1 minute.

18. A method according to claim 1, wherein the method occurs at ambient temperature.

19. A method according to claim 1, wherein the method occurs at about 20° C.

20. A method according to claim 1, further comprising, after electrolytic removal of the hard material coating, mechanically finishing the starting hard metal workpiece into the manufactured hard metal workpiece.

21. A method according to claim 20, wherein the mechanically finishing is at least one of polishing, grinding, or micro-sandblasting.

22. A method according to claim 1, wherein said starting hard metal workpiece has at least a first surface region with a layer of hard material and a second surface region with no layer of hard material, said method comprising bringing the said starting hard metal workpiece into contact with the electrolyte exclusively at the first surface region and wherein the second surface region is optionally encapsulated.

23. A method according to claim 1, wherein parts of a workpiece holder that are brought into contact with the electrolyte comprise a material that is passivated during the removing or that is not electrically conductive.

24. A method according to claim 23, wherein said material is at least one of tungsten, tantalum, or a plastic.

25. A method according to claim 24, wherein said material is polytetrafluoroethylene.

26. A method according to claim 1, further comprising recoating said starting hard metal workpiece after removing the coating by said electric passivation.

27. The method according to claim 26, further comprising recoating said starting hard metal workpiece with a hard material.

28. The method according to claim 26, wherein said manufactured hard metal workpiece is a tool, which is sharpened at least one of before and after removing said hard material coating.

29. The method according to claim 1, wherein said workpiece is a hopper.

30. A method according to claim 1, wherein said hard material layer comprises at least one of TiAlN, TIAlNC, TiAlC, WC, WCN, WN, CrN, CrC, CrNC, or Cr.

31. A holding device for at least one workpiece, comprising:

a first surface area to be treated by an electrolyte; and a second surface area not to be treated by the electrolyte; said holding device further comprising an encapsulation for a surface area of the at least one workpiece not to be treated by the electrolyte; and an electric contact in the encapsulation operatively connected with a mechanism for establishing an optimum electrical contact with said workpiece.

32. A holding device according to claim 31, further comprising sealing elements that separate and seal an inner surface from an outer surface of the at least one workpiece, wherein the workpiece is treated selectively at the inner surface of or at the outer surface.

33. A holding device according to claim 32, wherein the at least one workpiece which is providable with a blind indentation or a through hole.

34. A holding device according to claim 33, further comprising, for use with a workpiece having the through hole, a pair of sealing elements adapted to contact end surfaces around an opening at the workpiece and are axially offset along a supporting rod, a section of said rod being is located between the sealing arrangements and being dimensioned for being able to pass through the through hole.

35. A holding device according to claim 34, further comprising an electrical contact arrangement at the section of the rod between the sealing elements.

36. A holding device according to claim 35, wherein the electrical contact arrangement is configured to be supplied with electricity through the rod.

37. A holding device according to claim 34, further comprising holding device sections adjoining the sealing elements on either side on the outside, having an outer surface of at least one of tungsten, tantalum, or a plastic.

38. A holding device according to claim 37, wherein said outer surface is polytetrafluoroethylene.

39. A holding device according to claim 37, wherein said outer surface is polytetrafluoroethylene.

40. The holding device according to claim 31, wherein the electric contact is movable in a direction substantially orthogal to an actuating direction of the mechanism.

* * * * *